US007621339B2

(12) United States Patent
Johnson et al.

(10) Patent No.: US 7,621,339 B2
(45) Date of Patent: Nov. 24, 2009

(54) DOWNHOLE PRODUCTION AND INJECTION PUMP SYSTEM

(75) Inventors: Ashley B. Johnson, Cambridge (GB); Jonathan J. Elphick, Cambridge (GB)

(73) Assignee: Schlumberger Technology Corporation

( * ) Notice: Subject to any disclaimer, the term of this patent is extended or adjusted under 35 U.S.C. 154(b) by 277 days.

(21) Appl. No.: 11/674,796

(22) Filed: Feb. 14, 2007

(65) Prior Publication Data

US 2008/0190622 A1 Aug. 14, 2008

(51) Int. Cl.
*E21B 43/25* (2006.01)

(52) U.S. Cl. ..... 166/372; 166/105; 166/68

(58) Field of Classification Search ..... 166/105, 166/68, 372, 105.2
See application file for complete search history.

(56) References Cited

U.S. PATENT DOCUMENTS

| | | | | |
|---|---|---|---|---|
| 4,267,888 | A * | 5/1981 | Singer | 166/312 |
| 5,497,832 | A * | 3/1996 | Stuebinger et al. | 166/369 |
| 5,697,448 | A * | 12/1997 | Johnson | 166/369 |
| 6,032,743 | A * | 3/2000 | Bowlin et al. | 166/369 |
| 6,131,660 | A * | 10/2000 | Stuebinger et al. | 166/265 |
| 6,173,768 | B1 | 1/2001 | Watson | |
| 6,755,978 | B2 | 6/2004 | Oddie | |
| 6,854,518 | B1 | 2/2005 | Senyard, Sr. | |
| 2005/0098322 | A1 * | 5/2005 | Balen | 166/369 |

FOREIGN PATENT DOCUMENTS

| | | | |
|---|---|---|---|
| WO | WO 98/02637 | A1 | 1/1998 |
| WO | 00/17486 | A1 | 3/2000 |
| WO | 01/66910 | A1 | 9/2001 |
| WO | 02/10070 | A2 | 2/2002 |

* cited by examiner

*Primary Examiner*—Jennifer H Gay
*Assistant Examiner*—Nicole A Coy
(74) *Attorney, Agent, or Firm*—Winstead PC; Kevin Brayton McGoff; James L. Kurka

(57) ABSTRACT

A downhole pump, positionable in a fluid column that is substantially separated into an oil portion and a water portion, for selectively lifting the oil to a surface and injecting the water into an injection zone includes a housing having a top wall, and a bottom wall defining a cylinder; a plunger positioned within the cylinder reciprocable through an induction stroke and a production stroke; a piston moveably positioned between the plunger and the top wall separating an oil chamber from a water chamber; an oil intake assembly providing one-way fluid flow from the fluid column to the oil chamber, the oil intake assembly including means for selectively allowing induction of the oil and blocking induction of the water into the oil chamber; an oil exhaust providing one-way fluid flow from the oil chamber to the surface; a water intake providing one-way fluid flow from the fluid column to the water chamber; a flow restriction position in the water intake to substantially balance the pressure drop in the oil intake assembly; and a water discharge providing one-way fluid flow from the water chamber toward the injection zone. On the induction stroke the oil fluid is drawn into the oil chamber and the water is drawn into the water chamber at a preselected oil to water ratio, and on the production stroke the oil is produced to the surface and the water is injected into the injection zone if the injection zone pressure is overcome.

20 Claims, 2 Drawing Sheets

DOWNHOLE PRODUCTION AND INJECTION PUMP SYSTEM

FIELD OF THE INVENTION

The present invention relates in general to systems and methods for improving the economics of hydrocarbon production, and more specifically to a system that facilitates selective lifting of a desired portion of a reservoir fluid from a subterranean formation to the surface and for injecting the undesired portion of the reservoir fluid into another subterranean formation, wherein the system compensates for changes in the water-cut of the reservoir fluid and injectivity parameters.

BACKGROUND

Production wells penetrate subterranean formations whose yield, besides the desired lighter fluid, such as oil, includes a heavier undesirable fluid, such as water. Over time the percentage of water produced from the formation typically increases. The production of water to the ground surface results in increased costs in both the energy to lift the water to the surface and in surface handling. Accordingly, many wells become uneconomic due to excess water production.

The traditional method for producing a well with a high water-cut is to produce the total reservoir fluid to the surface. At the surface the water is separated from the desired hydrocarbon portion of the reservoir fluid. Disposal of the water is then commonly achieved by transportation to a disposal well where it is injected into an injection formation or zone. Thus, production of excess water to the surface significantly increases the costs of well operations and the risk of environmental impacts.

A second method of addressing high water-cut reservoir fluid is referred to as an "in-situ" approach. In the in-situ approach, the undesired water and the desired hydrocarbons are allowed to substantially separate in the wellbore. The desired fluid portion, and typically a portion of the undesired fluid, is then produced to the surface and the undesired portion is injected into a disposal formation ("injection zone"). The injection zone may be located above or below the producing reservoir formation.

While the prior in-situ systems provide the opportunity to decrease operation costs and thus increase a well's economic life, drawbacks have been noted in terms of compensation in changes in the water-cut of the reservoir fluids, compensation for changes in injectivity of the injection zone, complexity, and reliability. Thus, there is still a need for a downhole production and injection pump system that addresses increasing need to economically produce desired reservoir fluids to the surface from high water-cut reservoirs.

SUMMARY OF THE INVENTION

In view of the foregoing and other considerations, the present invention relates to a pump system that facilitates pumping a desired portion of a fluid from a well and injecting an undesired portion of the fluid into a disposal without lifting the undesired portion from the well.

In an embodiment of the invention a pump, positionable in a fluid column substantially separated into an undesired fluid portion and a desired fluid portion, for selectively lifting the desired fluid to a surface and injecting the undesired fluid into an injection zone includes a housing having a top wall, and a bottom wall defining a cylinder; a plunger positioned within the cylinder reciprocable through an induction stroke and a production stroke; a piston moveably positioned between the plunger and the top wall separating a desired fluid chamber from an undesired fluid chamber; a desired fluid intake assembly providing one-way fluid flow from the fluid column to the desired fluid chamber; a desired fluid exhaust providing one-way fluid flow from the desired fluid chamber to the surface; an undesired fluid intake providing one-way fluid flow from the fluid column to the undesired fluid chamber; and an undesired fluid discharge providing one-way fluid flow from the undesired fluid chamber toward the injection zone. On the induction stroke the desired fluid is drawn into the desired fluid chamber and the undesired fluid is drawn into the undesired fluid chamber, and on the production stroke the desired fluid is produced to the surface and the undesired fluid is injected into the injection zone if the injection zone pressure is overcome.

In another embodiment a downhole pump, positionable in a fluid column that is substantially separated into an oil portion and a water portion, for selectively lifting the oil to a surface and injecting the water into an injection zone includes a housing having a top wall, and a bottom wall defining a cylinder; a plunger positioned within the cylinder reciprocable through an induction stroke and a production stroke; a piston moveably positioned between the plunger and the top wall separating an oil chamber from a water chamber; an oil intake assembly providing one-way fluid flow from the fluid column to the oil chamber, the oil intake assembly including means for selectively allowing induction of the oil and blocking induction of the water into the oil chamber; an oil exhaust providing one-way fluid flow from the oil chamber to the surface; a water intake providing one-way fluid flow from the fluid column to the water chamber; a flow restriction position in the water intake to substantially balance the pressure drop in the oil intake assembly; and a water discharge providing one-way fluid flow from the water chamber toward the injection zone. On the induction stroke the oil fluid is drawn into the oil chamber and the water is drawn into the water chamber at a pre-selected oil to water ratio, and on the production stroke the oil is produced to the surface and the water is injected into the injection zone if the injection zone pressure is overcome.

A method of producing an oil portion of a fluid column in a well to the surface and injecting the water in the fluid column into an injection zone without lifting the water to the surface includes the steps of positioning a pump in the fluid column, the pump having a plunger reciprocating through an induction stroke and a production stroke, and a sliding sleeve separating an oil chamber from a water chamber; on the induction stroke, drawing the oil into the oil chamber and water into the water chamber on the induction stroke; and on the production stroke, producing the oil in the oil chamber to the surface and injecting the water from the water chamber into the injection zone if an injection pressure of the injection zone is overcome.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
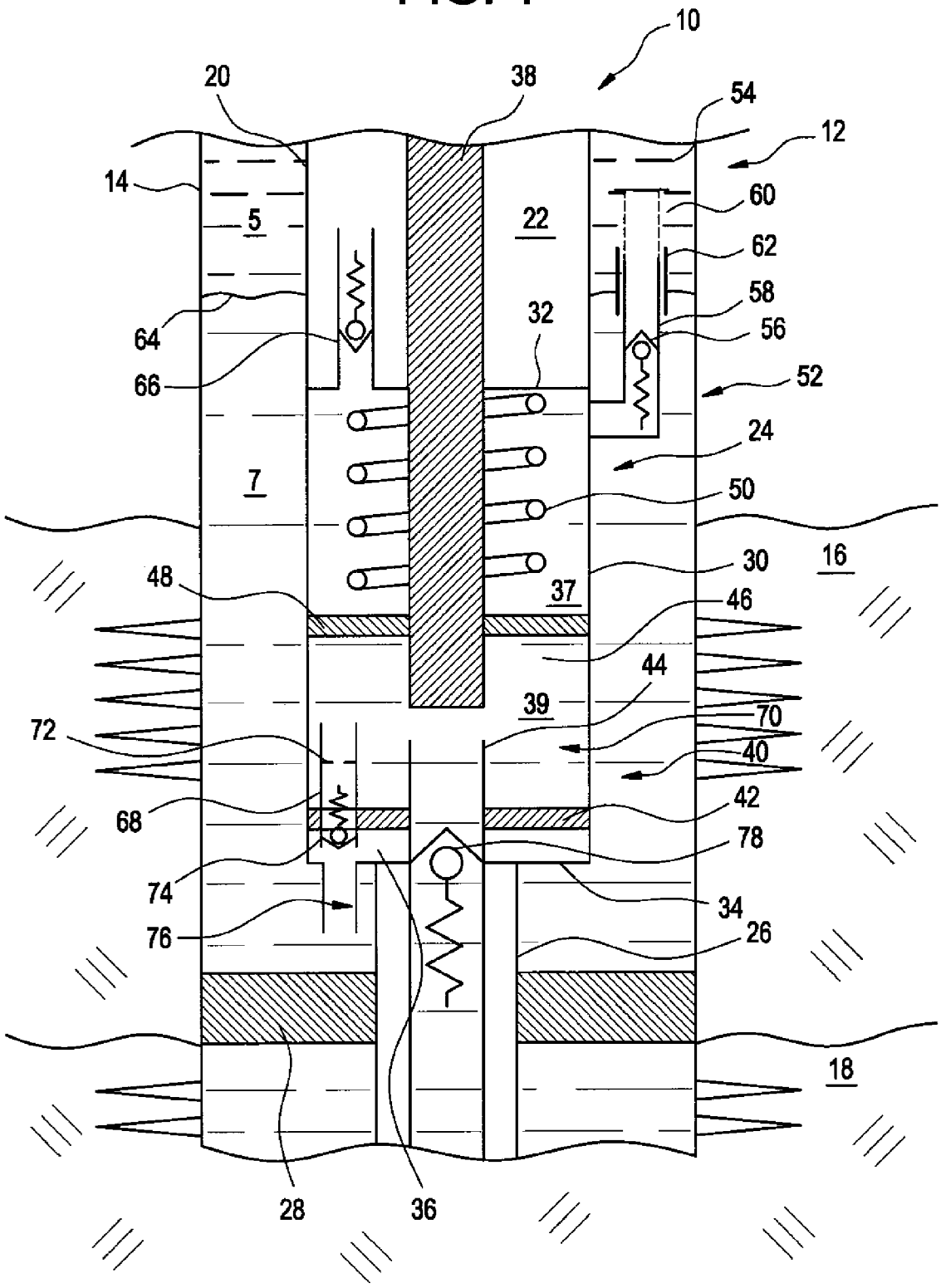
FIG. 1 is a schematic side elevation of an embodiment of a downhole pump system of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 illustrates an embodiment of a downhole pump system of the present invention, generally designated by the numeral 10, positioned within a well 12. Well 12 is typically completed with a casing string 14 having perforations adjacent to the producing formation 16 and injection formation 18. Producing formation 16 produces a reservoir fluid into well 12. For purposes of this description, the reservoir fluid comprises an oil portion 5 and a water portion 7. Oil 7 may include a percentage of water, but is primarily constituted of oil. Injection formation 18, which may be located above or below producing formation 16, is a reservoir formation selected for disposable of the water 7 portion of the reservoir fluid.

A tubing string 20, having an internal bore 22, extends downhole within casing 14 suspending pump 24 at the desired level in well 12. A sub 26 extends below pump 24 and through a packer 28 to carry the undesired water portion of the produced reservoir fluid to injection formation 18. Sub 26 may comprise a tubing string. The annulus 54 of well 12 is the area between casing 14, or the surrounding formation, and pump 24 and tubing string 20.

Pump 24 includes a housing 30 having a top wall 32 and a bottom wall 34 defining a pump cylinder 36. Pump housing 30 in the embodiment of FIG. 1, has a substantially constant diameter extending from top wall 32 to bottom wall 34. An opening or port 76 is formed through bottom wall 34, or proximate to bottom wall 34, providing fluid communication between cylinder 36 and annulus 54.

A shaft 38 extends through top wall 32 into cylinder 36 and is connected to plunger assembly 40 having a plunger 42. Shaft 38 is connected to or extends downhole from a sucker rod, not shown, that is connected to motivation means such as a pump jack or other reciprocating device for moving plunger assembly 40 within pump housing 30.

A sliding piston 48 is positioned within pump cylinder 36 between top wall 32 and plunger 42. Piston 48 divides cylinder 36 into an oil chamber 37, between top wall 32 and piston 48, and a water fluid chamber 39, between piston 48 and plunger 42. Sliding piston 48 is free to move separate from movement of shaft 38. A biasing mechanism 50, such as a spring, may be positioned in oil chamber 37 to act on piston 48. Biasing mechanism 50 provides a pre-load to control the differential between the water injection pressure and the pressure to lift the oil to the surface and to enhance oil induction priority.

Intake of oil 5 from the annulus 54 into pump 24 is provided by oil intake assembly 52. Oil intake assembly includes a line 58 in fluid communication between annulus 54 and oil chamber 37, and a check valve 56 providing one-way fluid flow from annulus 54 into chamber 37. Line 58 includes one or more ports 60 that are desirably positioned in oil 5 portion of the fluid column in annulus 54. In the illustrated embodiment, oil intake assembly 52 includes a fluid selection device to facilitate the preferential intake of oil 5 as opposed to water 7 and to adjust to changes in the level of the water-oil interface 64 in well 12. The fluid selection device is a valve member 62 in functional connection with ports 60 of line 58. In the illustrated embodiment, valve member 62 is a sliding sleeve that is constructed of a material having a density between that of water 7 and oil 5. Other suitable valve members, including float balls and the like may be utilized. Valve member 62 rides proximate to and with water-oil interface 64 exposing ports 60 to oil 5 and closing ports 60 to water 70. Other fluid intake selection mechanisms may be utilized in conjunction with or separate from the illustrated and described fluid selection device, such as an electronic fluid detection and valve operation.

Oil 5 is discharged from pump 24 into tubing 20 for production to the surface through oil discharge check valve 66 that provides one-way fluid flow from chamber 37 to bore 22 of tubing 20. Oil 5 may be produced from pump 24 to the surface via means other than tubing 20 as is well known in the art.

The flow of water 7 through pump 24 is provided by water intake 68 and water exhaust 70 which are part of plunger assembly 40. Water intake 68 is formed through plunger 42 which travels within housing 30. Water intake 68 includes a check-valve 74 providing one-way flow in the direction from below plunger 42 into chamber 39 above plunger 42. Water intake 68 includes a flow restriction 72, which may serve to balance the pressure drop in the oil intake 52.

Water discharge 70 includes a ported tubular 44 that extends from shaft 38 through pump housing 30. The ports 46 are positioned above plunger 42. Ported tubular 44 includes a one-way check valve 78 providing fluid flow from chamber 39 to exterior of housing 30 toward injection formation 18 for disposal. A hollow sucker rod having ports 46 is an example of an embodiment of the ported tubular 44.

Figure 2:
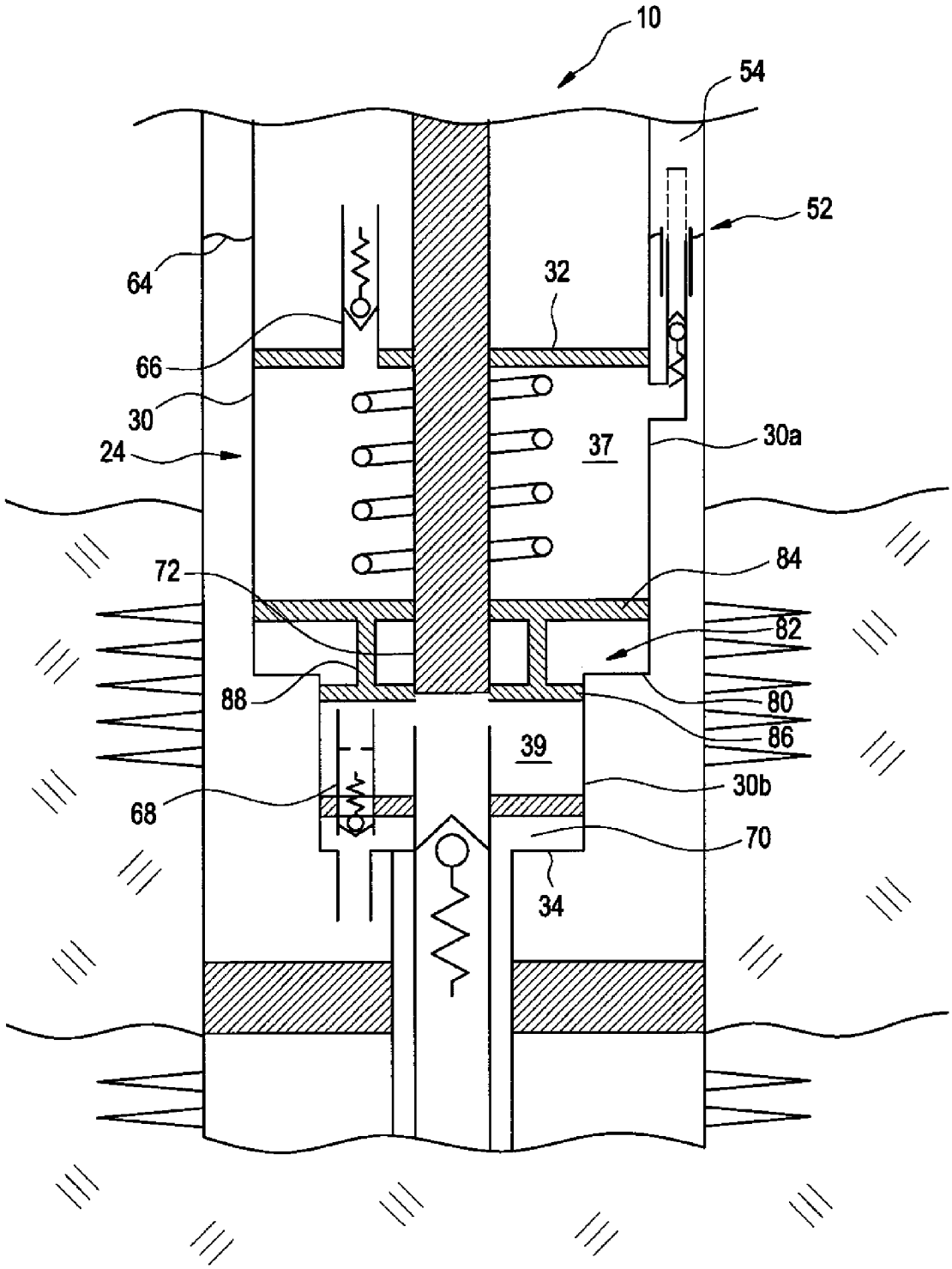
FIG. 2 is a schematic side elevation of another embodiment of a downhole pump system of the present invention.

FIG. 2 illustrates an embodiment of pump system 10 adapted to increase the water injection pressure and increase the preference for oil production to the surface. Pump housing 30 includes a first housing section 30*a* having a diameter greater than a second housing section 30*b*. First housing section 30*a* and second housing 30*b* are separated at shoulder 80. Sliding piston 48 of FIG. 1 is modified or replaced by the unbalanced piston 82 shown in FIG. 2. Unbalanced piston 82 includes an oil head 84 in communication with oil chamber 37 and water head 86 being in communication with water chamber 39. Oil head 84 has a larger diameter, and thus greater surface area, than water head 86. In the illustrated embodiment, oil head 84 and water head 86 are shown as separate members connected by struts 88, however it should be recognized that they may be opposing surfaces of a unitary member.

Operation of pump system 10 is now described with reference to FIG. 1. Pump 24 is run into well 12 on tubing 20 and landed so as to be positioned with the fluid column produced from formation 16. A packer 28 separates producing formation 16 from injection formation 18. A tubing sub 26 extends from water discharge 70 of pump 24 to injection zone 18. Pump 24 is in functional connection with a reciprocating mechanism, such as a pump jack, via a sucker rod to provide upward and downward movement of plunger assembly 40 within pump housing 30.

Reservoir fluid flows into well 12 from producing formation 16 and is allowed to separate into a predominantly oil 5 portion and a predominantly water portion 7 having a water-oil interface 64. Pump 24 is positioned such that port 76 is positioned within the water 7 portion of the fluid column. Oil intake assembly 52 is positioned such that fluid selection mechanism 62 is positioned proximate to the anticipated water-oil interface 64, such that variations in the level or height of interface 64 are within the range of travel of mechanism 62. Prior to running pump 24 into well 12, the maximum and minimum oil/water split or ratio inducted into pump 24 can be set by sizing biasing mechanism 50, flow restriction 72, and/or oil intake assembly 52. The actual water may then be governed by the water cut of the reservoir fluid produced from formation 16.

Pump 40 has a downward, induction stroke and an upward, production stroke. On the induction stroke, shaft 38 and plunger assembly 40 are moved toward bottom wall 34. Oil 5 is drawn through oil intake assembly 52 into oil chamber 37 located above sliding piston 48. Water 7 is inducted through water intake 68 into chamber 39 simultaneous with the induction of oil 5 into chamber 37. Piston 48 slides relative to plunger assembly 40, accommodating the selected variations in the split between water intake 68 (chamber 39) and oil intake 52 (chamber 37). As previously noted, the minimum and maximum water to oil ratios can be set prior to placement of pump 24. As the water 7 column rises in annulus 54, member 62 travels with the rising water-oil interface 62 closing ports 60 that would be exposed to water 7 and leaving ports 60 exposed to oil 5 open.

On the production stroke, shaft 38 and plunger assembly 40 are moved toward top wall 32. Oil 5 is discharged from chamber 37 through oil discharge 66 into tubing 20 and to the surface. In the typical installation, the water injection pressure will be greater than the hydrostatic head to produce the oil to the surface. Thus, piston 48 will travel with plunger assembly 40 until it contacts biasing mechanism 50. Once the travel of piston 48 is halted, water 7 is pumped from chamber 39 out of water discharge 70 to injection formation 18 as plunger 42 continues on the upstroke. The unbalanced pump system 10 may be utilized to increase the pressure of the water injection pressure.

If the injectivity of formation 18 increases (i.e., injection pressure decreases) rapidly during the production stroke, then water 7 will be pumped out of pump 24 first as in normal operation. The split between the water injected and the oil produced to the surface will not be changed as the split is a function of the induction stroke.

If the injectivity of formation 18 decreases (i.e., the injection pressure increases) such as due to plugging, then the pressure in chamber 39 will not overcome the pressure at water discharge 70, thus piston 48 will remain stationary relative to plunger assembly 40 and both water and oil will be produced to the surface as in a conventional downhole pump. On the induction stroke, no water will be inducted through water intake 68 into chamber 39.

From the foregoing detailed description of specific embodiments of the invention, it should be apparent that a downhole pump system for selectively pumping a desired fluid to the surface and injecting the undesired portion of the fluid, selecting the split of desired fluid lifted to the undesired fluid injected, and that compensates for changes in the water-cut of the wellbore fluid and injectivity of the injection zone that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow. Although the present invention has been described and illustrated in relation primarily to oil production systems, the present invention is suited for use in various applications and within various fluids that can be separated into at least two portions of varying density.

What is claimed is:

1. A pump, positionable in a fluid column substantially separated into an undesired fluid portion and a desired fluid portion, for selectively lifting the desired fluid to a surface and injecting the undesired fluid into an injection zone, the pump comprising:

a housing having a top wall, and a bottom wall defining a cylinder;

a plunger positioned within the cylinder reciprocable through an induction stroke and a production stroke;

a piston moveably positioned between the plunger and the top wall separating a desired fluid chamber from an undesired fluid chamber;

a desired fluid intake assembly providing one-way fluid flow from the fluid column to the desired fluid chamber;

a desired fluid exhaust providing one-way fluid flow from the desired fluid chamber to the surface;

an undesired fluid intake providing one-way fluid flow from the fluid column to the undesired fluid chamber; and an undesired fluid discharge providing one-way fluid flow from the undesired fluid chamber toward the injection zone;

wherein on the induction stroke the desired fluid is drawn into the desired fluid chamber and the undesired fluid is drawn into the undesired fluid chamber, and on the production stroke the desired fluid is produced to the surface and the undesired fluid is injected into the injection zone if the injection zone pressure is overcome.

2. The pump of claim 1, wherein the induction stroke is a downward stroke of the plunger and the production stroke is an upward stroke of the plunger.

3. The pump of claim 1, further including a biasing mechanism in loading connection with the piston.

4. The pump of claim 1, further including a flow restriction within the undesired fluid intake.

5. The pump of claim 1, wherein the desired fluid intake assembly includes a means for selectively allowing induction of the desired fluid and blocking induction of the undesired fluid.

6. The pump of claim 1, wherein the desired fluid intake assembly includes a valve member having a density between that of the desired fluid and the undesired fluid such that the valve member allows flow of the desired fluid into the desired fluid intake assembly and substantially blocks flow of the undesired fluid into the desired fluid intake assembly.

7. The pump of claim 1, further including means for selecting the ratio of desired fluid to undesired fluid drawn into the pump on the induction stroke.

8. The pump of claim 4, wherein the flow restriction is selected to substantially balance the pressure drop through the desired fluid intake assembly on the induction stroke.

9. The pump of claim 1, wherein the undesired fluid intake and the undesired fluid discharge travel with the plunger.

10. The pump of claim 1, wherein the desired fluid is drawn into the desired fluid chamber and the undesired fluid is drawn into the undesired fluid chamber substantially simultaneously.

11. The pump of claim 1, further including:

a biasing mechanism in loading connection with the piston; and a flow restriction positioned within the undesired fluid intake to substantially balance the pressure drop through the desired fluid intake assembly on the induction stroke.

12. The pump of claim 1, further including:

a biasing mechanism in loading connection with the piston; and a means for selectively allowing induction of the desired fluid and blocking induction of the undesired fluid into the desired fluid chamber.

13. A downhole pump, positionable in a fluid column that is substantially separated into an oil portion and a water portion, for selectively lifting the oil to a surface and injecting the water into an injection zone, the pump comprising:

a housing having a top wall, and a bottom wall defining a cylinder;

a plunger positioned within the cylinder reciprocable through an induction stroke and a production stroke;

a piston moveably positioned between the plunger and the top wall separating an oil chamber from a water chamber;

an oil intake assembly providing one-way fluid flow from the fluid column to the oil chamber, the oil intake assembly including means for selectively allowing induction of the oil and blocking induction of the water into the oil chamber;

an oil exhaust providing one-way fluid flow from the oil chamber to the surface;

a water intake providing one-way fluid flow from the fluid column to the water chamber;

a flow restriction position in the water intake to substantially balance the pressure drop in the oil intake assembly; and a water discharge providing one-way fluid flow from the water chamber toward the injection zone;

wherein on the induction stroke the oil fluid is drawn into the oil chamber and the water is drawn into the water chamber at a pre-selected oil to water ratio, and on the production stroke the oil is produced to the surface and the water is injected into the injection zone if the injection zone pressure is overcome.

14. The pump of claim 13, wherein the selective fluid means includes a valve member having a density between the density of the water and the oil.

15. A method of producing an oil portion of a fluid column in a well to the surface and injecting the water in the fluid column into an injection zone without lifting the water to the surface, the method comprising the steps of:

positioning a pump in the fluid column, the pump having a plunger reciprocating through an induction stroke and a production stroke, and a sliding sleeve separating an oil chamber from a water chamber;

on the induction stroke, drawing the oil into the oil chamber and water into the water chamber; and on the production stroke, producing the oil in the oil chamber to the surface and injecting the water from the water chamber into the injection zone if an injection pressure of the injection zone is overcome.

16. The method of claim 15, wherein on the induction stroke, the oil and water are drawn into the pump at a predetermined oil to water ratio.

17. The method of claim 15, wherein the pump includes means for selectively allowing induction of the oil into the oil chamber and blocking flow of water into the oil chamber.

18. The method of claim 15, wherein the pump includes a biasing mechanism in loading connection with the sliding sleeve.

19. The method of claim 16, wherein the pump includes:

a biasing mechanism in loading connection with the sliding sleeve; and means for selectively allowing induction of the oil through an oil intake assembly into the oil chamber and blocking flow of water into the oil chamber.

20. The method of claim 19, wherein the pump further includes a flow restriction within a water intake into the water chamber to substantially balance the pressure drop through the oil intake assembly.

* * * * *